US006439787B1

(12) United States Patent
Kerr

(10) Patent No.: US 6,439,787 B1
(45) Date of Patent: Aug. 27, 2002

(54) SHEET METAL PRINT ENGINE CHASSIS ASSEMBLED WITHOUT FASTENERS

(75) Inventor: Roger S. Kerr, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/751,227

(22) Filed: Dec. 28, 2000

(51) Int. Cl.[7] ..... B41J 29/02
(52) U.S. Cl. ..... 400/691; 346/145
(58) Field of Search ..... 400/691, 693; 346/145; 312/223.1, 223.2

(56) References Cited

U.S. PATENT DOCUMENTS 5,268,708 A 12/1993 Harshbarger et al. ..... 346/134
5,369,549 A 11/1994 Kopp et al. ..... 361/679
6,165,008 A * 12/2000 Wu et al. ..... 439/492
6,364,555 B1 * 4/2002 Kerr ..... 400/691

FOREIGN PATENT DOCUMENTS

JP 59198176 A * 11/1984 ..... B41J/19/20
JP 63242675 A * 10/1988 ..... B41J/29/02
JP 01275174 A * 11/1989 ..... B41J/29/02
JP 11334174 A * 12/1999 ..... B41J/29/02
JP 2000186711 A * 7/2000 ..... F16C/11/04

* cited by examiner

*Primary Examiner*—Daniel J. Colilla
(74) *Attorney, Agent, or Firm*—Arthur I. Navarro

(57) ABSTRACT

A printer chassis (12) comprising several sheet metal structural members. The printer chassis (12) is fabricated by joining the sheet metal structural members using tab-and-slot junctions to form a printer chassis (12) for holding printing equipment such as an imaging drum (64) and a printhead (44). Spring tabs (36) are used to allow the printer chassis (12) to be assembled without tools. A spring tab (36) locks into a slot (38) when inserted through the slot (38).

8 Claims, 5 Drawing Sheets

SHEET METAL PRINT ENGINE CHASSIS ASSEMBLED WITHOUT FASTENERS

FIELD OF THE INVENTION

This invention generally relates to printer apparatus and methods of manufacture. More particularly the invention relates to a printer chassis fabricated using sheet metal members that fit together without separate fasteners or tools.

BACKGROUND OF THE INVENTION

Pre-press color proofing is a procedure used by the printing industry for creating representative images of printed material. This procedure avoids the high cost and time required to produce printing plates and also avoids setting-up a high-speed, high-volume printing press to produce a representative sample of an intended image for proofing. Otherwise, in the absence of pre-press proofing, a production run may require several corrections and be reproduced several times to satisfy customer requirements. This results in lost profits. By utilizing pre-press color proofing, time and money are saved.

A laser thermal printer having half-tone color proofing capabilities is disclosed in commonly assigned U.S. Pat. No. 5,268,708 titled "Laser Thermal Printer With An Automatic Material Supply" issued Dec. 7, 1993 in the name of R. Jack Harshbarger, et at. (Harshbarger, et al.) The Harshbarger, et al. device is capable of forming an image on a sheet of thermal print media by transferring dye from a roll of dye donor material to the thermal print media. This is achieved by applying a sufficient amount of thermal energy to the dye donor material to form the image on the thermal print media. This apparatus generally comprises a material supply assembly, a lathe bed scanning subsystem (which includes a lathe bed scanning frame, a translation drive, a translation stage member, a laser printhead, and a rotatable vacuum imaging drum), and exit transports for exit of thermal print media and dye donor material from the printer.

Although the printer disclosed in the Harshbarger, et al. patent performs well, there is a long-felt need to reduce manufacturing costs for this type of printer and for similar types of imaging apparatus. With respect to the lathe bed scanning frame disclosed in the Harshbarger, et al. patent, the machined casting used as the frame represents significant cost relative to the overall cost of the printer. Cost factors include the design and fabrication of the molds, the casting operation, and subsequent machining needed in order to achieve the precision necessary for a lathe bed scanning engine used in a printer of this type.

Castings present inherent problems in modeling, making it difficult to use tools such as finite element analysis to predict the suitability of a design. Moreover, due to shrinkage, porosity, and other manufacturing anomalies, it is difficult to obtain uniform results when casting multiple frames. In the assembly operation, each frame casting must be individually assessed for its suitability to manufacturing standards and must be individually machined. Further, castings also exhibit frequency response behavior, such as to resonant frequencies, which are difficult to analyze or predict. For this reason, the task of identifying and reducing vibration effects can require considerable work and experimentation. Additionally, the overall amount of time required between completion of a design and delivery of a prototype casting can be several weeks or months.

Alternative methods used for frame fabrication have been tried, with some success. For example, welded frame structures have been used. However, these welded structures require skilled welding and significant expense in manufacture.

Depending on the weight and forces exerted by supported components, a sheet metal structure, by itself, may provide sufficient support for a print engine chassis structure. However, the construction of a sheet metal chassis can require a considerable number of fasteners for assembly. This adds cost and complexity to the chassis assembly operation, adding to the total number of parts needed to build a chassis and increasing the number of manufacturing steps.

Snap-together assemblies that do not require fasteners have been utilized for electronic devices, as disclosed in U.S. Pat. No. 5,369,549 (Kopp, et al.). Kopp, et al. discloses a casing assembled without tools. However, printer chassis have been designed to use fastener hardware, which adds cost and complexity to the manufactured printer.

In summary, printer solutions have been limited to the use of conventional castings or weldments. or have employed fasteners for holding chassis parts together. As such, a printer chassis that overcomes these problems would provide numerous advantages.

SUMMARY OF THE INVENTION

An object of the present invention is to provide a sheet metal structure for a print engine chassis that can be assembled without fasteners. The goal is to provide a chassis that is structurally rigid, economical, and easy to manufacture.

With the above objects in view, the present invention provides a printer chassis for supporting an imaging drum and a printhead translation assembly, the chassis comprising a skeletal structure of interlocking rigid members that interlock without fasteners.

According to an embodiment of the present invention, sheet metal pieces are cut to form the interlocking rigid members, having spring tabs and slots that allow the interlocking rigid members to be quickly assembled by hand in order to form the skeletal structure of the printer chassis.

In another embodiment of the present invention, a spring tab to hold two structural members of a printer chassis is disclosed. The spring tab, on a first structural member, has a shoulder and a spring member which pass through a slot in a second structural member. The shoulder is pressed against one end of the slot by the spring member pressing against the other end of the slot. A hook is provided on the end of the spring tab to lock the structural members together and prevent them from being able to separate.

Also disclosed is a method for assembling a printer chassis by arranging structural members in interconnecting position relative to each other and pushing a spring tab of one structural member through a corresponding slot in another structural member to lock the structural members to each other.

A technical advantage of the present invention is a printer chassis that can be easily manufactured but is sufficiently rigid to act as a suitable replacement for a metal casting or weldment in some applications.

Another advantage of the present invention is that individual interlocking rigid members can be modified in order to change the design of the printer chassis, and even to modify the size or configuration of the overall structure. This contrasts with methods using a casting, which cannot be easily modified or scaled dimensionally.

Another advantage of the present invention is that an individual interlocking rigid member can be fabricated to allow its use with a number of different configurations. By providing alternate slot and tab features on a rigid member, a designer can allow its use in a number of different ways, as assembled. This results in potential cost savings, cutting down the number of parts that would be needed to support multiple printer configurations.

BRIEF DESCRIPTION OF THE DRAWINGS

For a more complete understanding of the present invention, including its features and advantages, reference is made to the following detailed description of the invention, taken in conjunction with the accompanying drawings in which.

Corresponding numerals and symbols in the figures refer to corresponding parts in the detailed description unless otherwise indicated.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. These specific embodiments discussed herein are merely illustrative of specific ways to make and use the invention, and do not delimit the scope or application of the invention.

Figure 1:
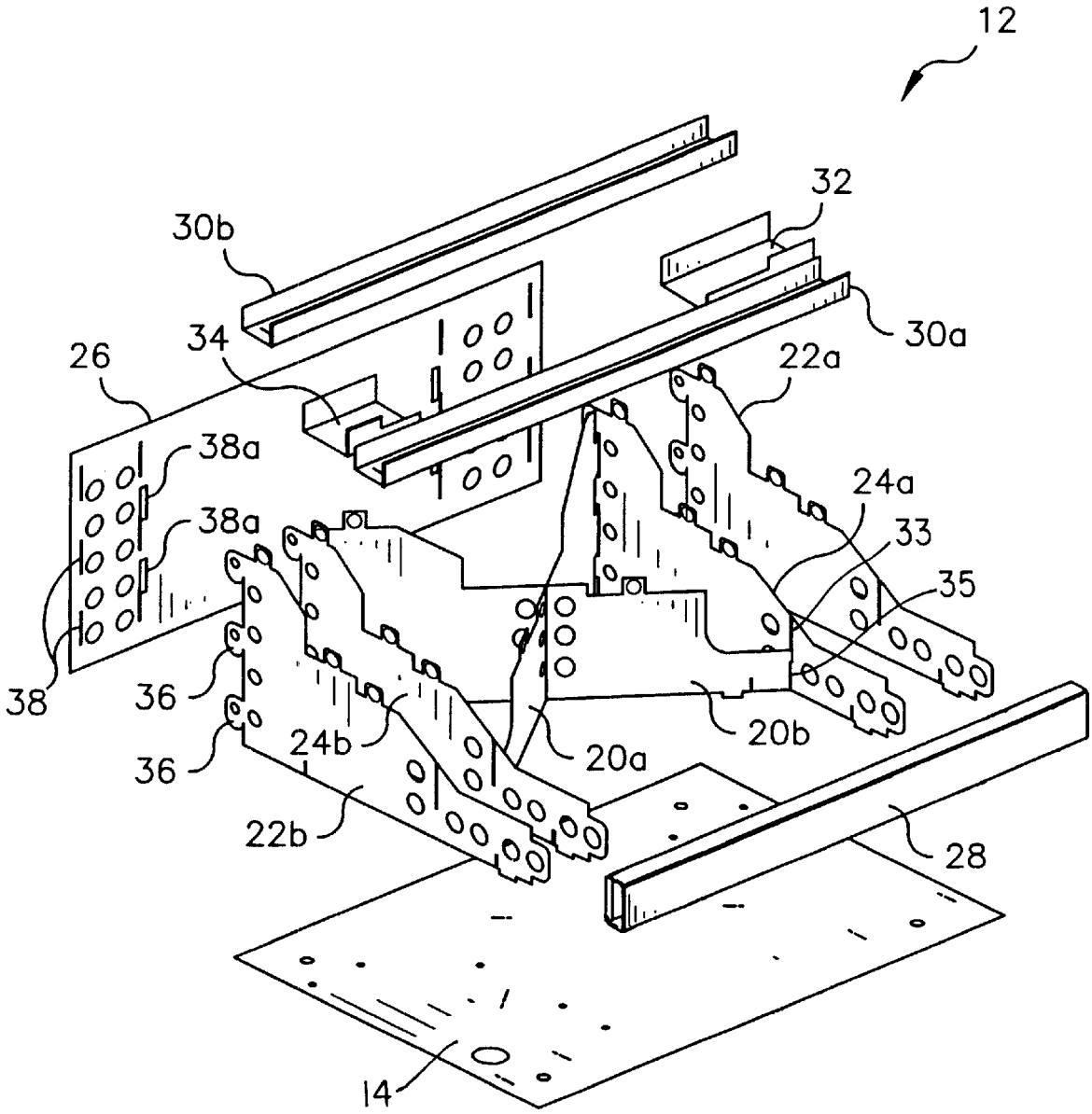
FIG. 1 is an exploded view in perspective of a skeletal sheet metal structure for a printer chassis assembled without fasteners.

Referring to FIG. 1, therein is shown an exploded view of a printer chassis 12. Printer chassis 12 comprises a rear wall 26 having slots 38 designed to connect side walls 22 and inner walls 24. Rear wall 26 also has cross brace slots 38*a* which allow a cross brace member to be installed. Slots 38 may accept different walls, depending on the specific needs of the printer chassis 12. Inner wall 24*a* has a first notch 33, which interlocks with a corresponding second notch 35 on cross brace 20*b*. Similarly, inner wall 24*b* and cross brace 20*a* are joined with interlocking notches.

In the preferred embodiment, side wall 22*a* is installed on the right side of printer chassis 12 between rear wall 26 and a front member 28. Next, inner wall 24*a* is installed between rear wall 26 and front member 28 and is joined with cross braces 20*a*, 20*b*. As shown, cross braces 20*a*, 20*b* form an X-shaped brace in the middle of printer chassis 12. Second inner wall 24*b* is on the left side of cross braces 20*a*, 20*b* and connects rear wall 26 and front member 28. Also, the left side of printer chassis 12 is formed by side wall 22*b* which, in turn, connects rear wall 26 with front member 28.

The bottom of printer chassis 12 is formed by base 14. Base 14 is held in position between front member 28 and rear wall 26 and is joined to walls 22*a*, 22*b*, and 24*a*, 24*b* and cross braces 20*a*, 20*b*. In order to provide side to side stability, full length cross braces 30*a*, 30*b* are placed on top of side walls 22*a*, 22b. Full length cross braces 30*a*, 30*b* are also connected to inner walls 24*a*, 24*b*.

Additional strengthening is added by placing a short strut across an inner wall and a side wall. For example, one short strut is right cross strut 32 between inner wall 24*a* and side wall 22*a*. Likewise, the left side of printer chassis 12 is strengthened by a short strut, left cross strut 34, which is placed between side wall 22*b* and inner wall 24*b*. Walls 24*a*, 24*b* and 22*a*, 22*b* have spring tabs 36 protruding from edges to interlock with slots 38 provided in other members, such as rear wall 26.

Those skilled in the art will recognize that spring tabs 36 may be used to interconnect a variety of different parts making up printer chassis 12. In the preferred embodiment, sheet steel of 0.090 in. thickness (nominal) is used to provide sufficient strength. Sheet steel members can be cut from stock using laser cutting techniques, well known in the sheet metal art. Laser cutting is used to produce laser cut edges on parts such as spring tabs 36 and other structural members.

Referring again to FIG. 1, sheet metal structures that form sheet metal printer chassis 12 are joined using slot-and-tab construction. At each junction of sheet metal members, a slot 38 is provided. In this arrangement, slot 38 mates with a corresponding slot 38 on a joining member or slot 38 is fitted to a spring tab 36. Cross-brace slots 38a are widened to seat tabs 36 from cross braces 20*a* and 20*b*. Selected structural members may be connected with plain tabs inserted into slots 38 when a locking capability is not required. In addition, slot-in-slot construction, as is known to those skilled in the art, can be used to assemble some structural members. For example, cross brace 20*a* and cross brace 20*b* are joined with interlocking slots 38 at the intersection of the X-shape.

Figure 2:
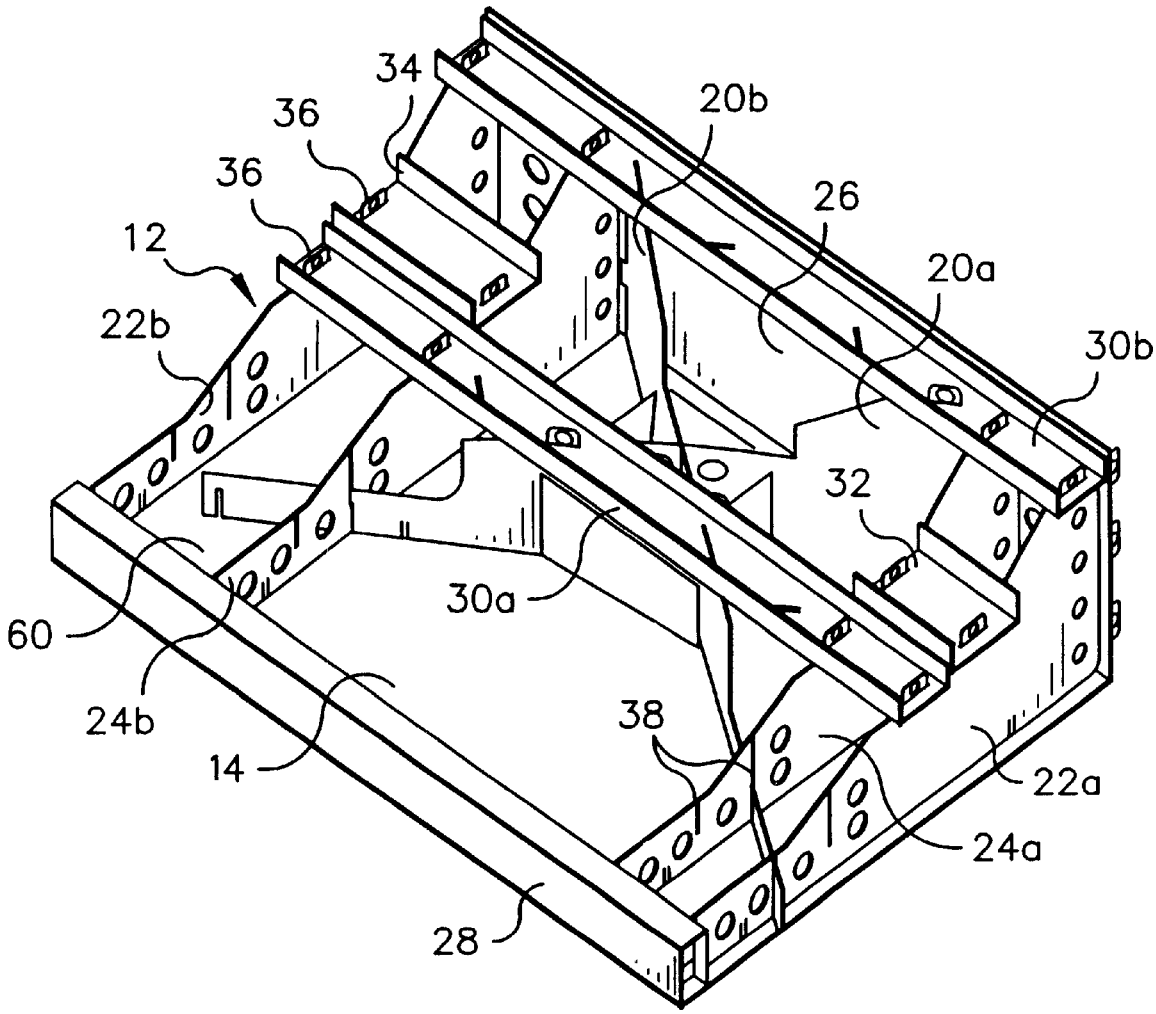
FIG. 2 illustrates an assembled printer chassis of the preferred embodiment of the invention.

In FIG. 2, an assembled printer chassis 12 is shown.

Accordingly, the positions of side walls 22*a*, 22*b*, the inner walls 24*a*, 24*b*, cross brace 20*a*, 20*b*, rear wall 26, front member 28 and base 14 are all assembled to form the preferred embodiment of printer chassis 12. The preferred embodiment of printer chassis 12 may be assembled by pressing the slots 38 against spring tabs 36. The spring tab 36 slides through slot 38 and locks into position holding printer chassis 12 firmly assembled. Since no tools are required to push spring tab 36 into slot 38, the joint is made quickly and efficiently. Specifically, printer chassis 12 is assembled without the need for any tools or additional fasteners such as screws, bolts, adhesive, or other fasteners known to those skilled in the art.

Using an arrangement of sheet metal members configured as is shown in FIGS. 1 and 2, it can be seen that a printer chassis 12 can be implemented that allows re-use of the same members for different print engine configurations. For example, inner wall 24*a* could be disposed further to the right within printer chassis 12. This might be preferable, for example, where the weight of supported motor structures requires additional support. By cutting additional slots 38 into front member 28, cross braces 20*a* and 20*b*, and rear wall 26, inner wall 24*b* could be suitably repositioned in a number of different locations, at different distances from side wall 22*b*. Alternately, the overall dimensions of sheet metal printer chassis 12 could be altered while using many of the same sheet metal members. For example, the length of printer chassis 12 could be changed simply by altering the lengths of full-length cross struts 30*a* and 30*b*, front member 28, base 64, and rear wall 26.

Figure 3A:
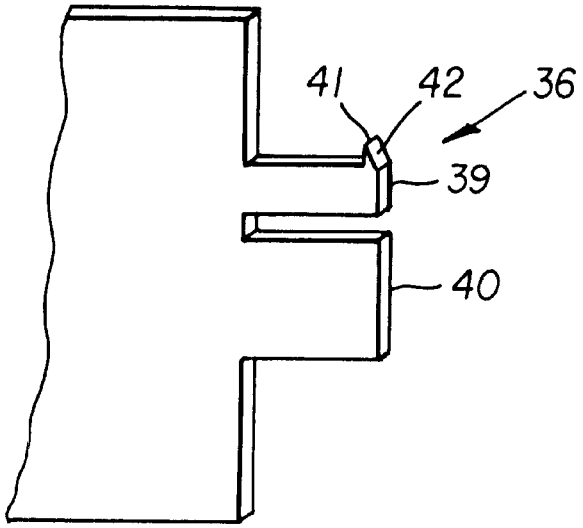
FIGS. 3*a* and 3*b* are views showing a spring tab according to an embodiment of the invention.

FIG. 3*a* illustrates a typical spring tab 36. It can be seen that spring tab 36 has a shoulder portion 40 and a spring member portion 39. Spring member 39 moves back and forth so that its hooked portion will slide into a slot 38 and hold it firmly in position by resisting forces that would cause spring tab 36 to be withdrawn from slot 38. In the preferred embodiment, spring member 39 has a ramp 42 on hook 41. The ramp 42 is an angled portion of hook 41 that acts as a guide to assist in moving spring member 39 when spring tab 36 is inserted through slot 38. For example, as a spring tab 36 is pushed into a slot 38, ramp 42 on spring member 39 will force spring member 39 to move towards shoulder 40. When spring tab 36 is pushed far enough into slot 38 for hook 41 to clear slot 38, spring member 39 snaps back towards its original position.

Figure 3B:
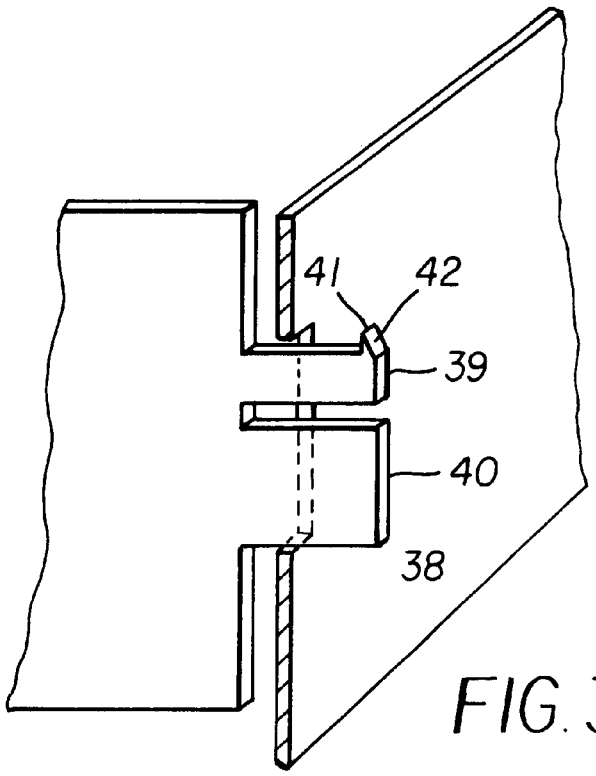

As is shown in FIG. 3*b*, spring tab 36 has been slid through a slot 38 in a second structural member and is now held in place by hook 41 so that it cannot slide back out of slot 38. For a rigid printer chassis 12, spring member 39 should press against one end of slot 38. Accordingly, spring member 39 will push shoulder 40 against the opposite end of slot 38. When hook 41 is inserted through slot 38 and spring member 39 snaps back, hook 41 is positioned to prevent spring tab 36 from being withdrawn from slot 38. Specifically, hook 41 locks spring tab 36 and slot 38 together. For a strong structurally rigid printer chassis 12, hook 41 needs to firmly hold the structural member around slot 38 in firm contact with the structural member having spring tab 36. If the structural members are not held firmly together, the structural members of printer chassis 12 will be able to move relative to each other.

Accordingly, movement of structural members is undesirable in a printer chassis 12 since the object of printer chassis 12 is to provide a rigid structure for mounting the printing components of a print engine. A print engine needs a rigid chassis since many of the components of a print engine must be held in very specific positions relative to each other for an image to be successfully printed on a media such as paper or thermal print media.

Figure 4:
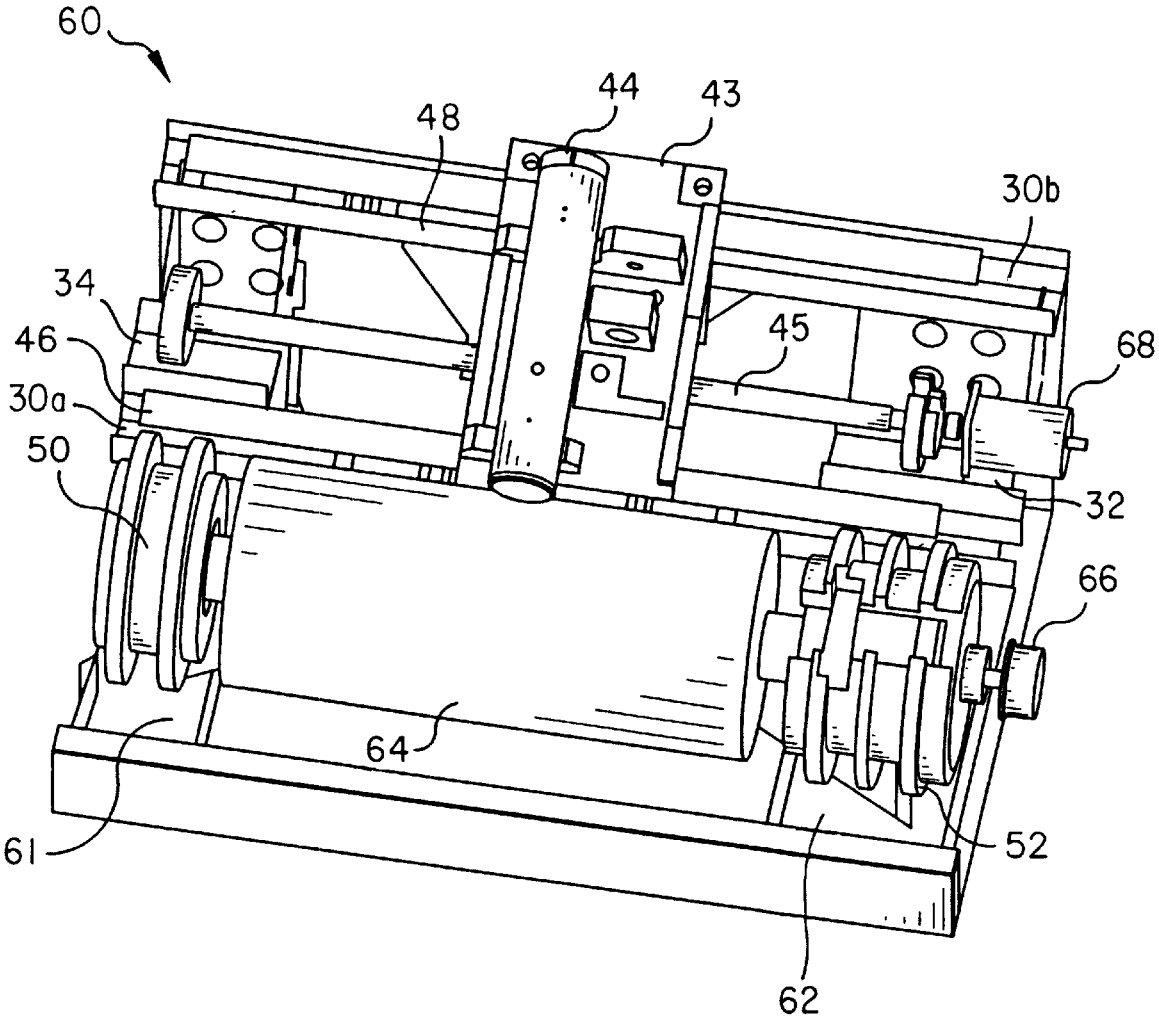
FIG. 4 is a view in perspective of a print engine having an imaging drum, printhead translation assembly, and associated motors.

Referring to FIG. 4, print engine 60 is shown. Print engine 60 is built by attaching printer components to printer chassis 12. Specifically, a left hub-end 50 is attached in left side cavity 61 and a corresponding right hub-end 52 is attached in right side cavity 62. An imaging drum 64 is mounted between the hub-ends 50,52. The motion of imaging drum 64 is controlled by drum motor 66.

A front guide rail 46 is mounted in full-length cross strut 30a and rear guide rail 48 is mounted in full length cross strut 30*b*. These guide rails 46 and 48 are tracks for printhead transport 43 to move across printer chassis 12. Printhead transport 43 holds printhead 44 in position relative to imaging drum 64. Those skilled in the art of printer design will appreciate how to position printhead 44 relative to imaging drum 64. Finally, a lead screw 45 is mounted on right cross strut 32 and left cross strut 34. Lead screw 45 is a rod with threads running along the length of the rod. Printhead transport 43 is designed to engage the threads of lead screw 45, thus printhead transport 43 will transverse across printer chassis 12, along guide rails 46 and 48 as lead screw 45 is rotated.

Preferably, translation motor 68 is coupled to lead screw 45 to control the movement of printhead transport 43 and thus the movement of printhead 44. For example, when lead screw 45 turns in a clockwise direction, printhead transport will move to the left across printer chassis 12 and when lead screw 45 moves in a counter clockwise direction, printhead transport 43 will move to the right across printer chassis 12. Those skilled in the art of printer design will recognize that the actual directions of travel for printhead transport 43 are determined by the threads on lead screw 43 and may be varied for the particular application.

Referring again to FIG. 4, it can be seen that the design of sheet metal printer chassis 12 allows a flexible arrangement of components for print engine 60. For example, relative widths of left side cavity 61 and right side cavity 62 could be switched to reverse the arrangement of drum motor 66 and hub ends 50 and 52. Print engine 60 could thereby be modified to optimize a writing direction, such as by reversing the path traveled by printhead transport 43.

Figure 5:
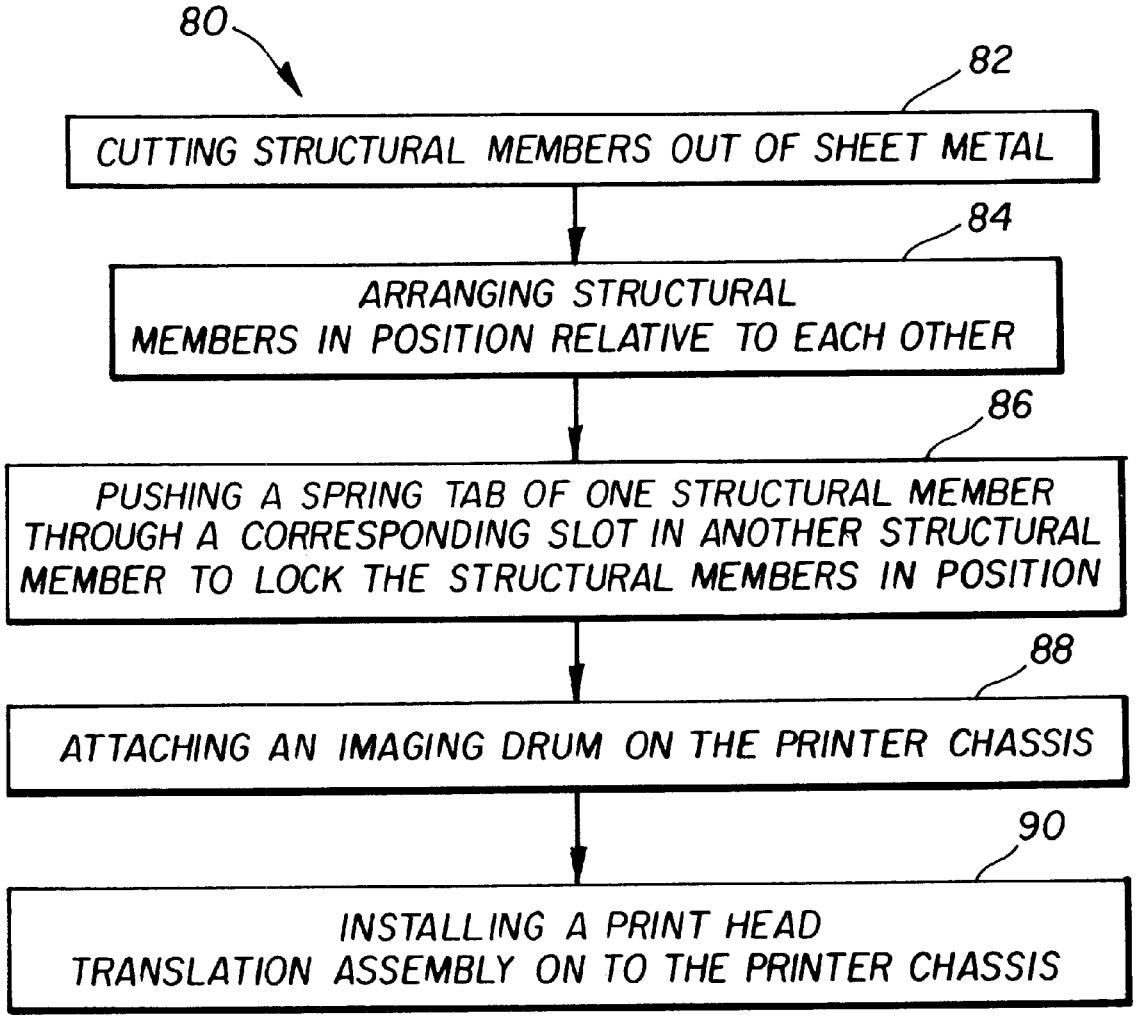
FIG. 5 is a flowchart illustrating the process of assembling a printer chassis according to one embodiment of the invention.

In FIG. 5, a flow chart for a method, denoted generally as 80, of assembling a printer chassis according to the invention is shown. The first step 82 involves cutting the structural members out of sheet metal. The preferred manner of cutting is with a laser cutting machine. However, those skilled in the arts will recognize that that the structural members may also be die cut or cut by other similar means. Next, in step 84, the structural members are arranged in position relative to each other. Process flow is directed to step 86 in which the spring tabs 36 of each structural member are pushed through a corresponding slot 38 in another structural member. Steps 84 and 86 may be repeated as necessary to complete the assembly of the printer chassis 12. Next, in step 88, an imaging drum 64 is attached to the printer chassis. Finally, in step 90 a printhead translation assembly is attached to printer chassis. A typical printhead translation assembly will consist of a printhead 44, a printhead transport 43, guide rails 46 and 48, a lead screw 45 and a translation motor 68. Those skilled in the art will appreciate that the steps of method 80 may be performed in a different order or repeated as necessary for a specific printer chassis, such as printer chassis 12.

While the invention has been described with particular reference to its preferred embodiments, it will be understood by those skilled in the art that various changes may be made and equivalents may be substituted for elements of the preferred embodiments without departing from the true scope and spirit of the invention. For example, sheet metal could be replaced at selective locations in the printer chassis, such as by rigid plastic members. A variety of filler materials could be used, with formulations optimized for the specific application. Therefore, what is provided is a printer chassis of rigid sheet metal and a method of assembling the printer chassis. It is, therefore, intended that the appended claims encompass these and any other such modifications or embodiments.

PARTS LIST

12 Sheet metal printer chassis
14 Base
20*a* Cross-brace
20*b* Cross-brace
22*a* Side wall
22*b* Side wall
24*a* Inner wall
24*b* Inner wall
26 Rear wall
28 Front member
30*a* Full-length cross-strut
30*b* Full-length cross-strut
32 Right cross-strut
33 First notch
34 Left cross-strut
35 Second notch
36 Spring tab
38 Slot
38*a* Cross-brace,lots
39 Spring member
40 Shoulder

41 Hook
42 Ramp
43 Printhead transport
44 Printhead
45 Lead screw
46 Front guide rail
48 Rear guide rail
50 Left hub-end
52 Right hub-end
60 Print engine
61 Left side cavity
62 Right side cavity
64 Imaging drum
66 Drum motor
68 Translation motor

What is claimed is:

1. A printer chassis using fasteners formed in one piece with the chassis structural members comprising:

a front member having a predetermined number of slots;

a rear wall having a predetermined number of slots;

first and second side walls adapted to insert into said slots of said front member and said rear wall to form a printer chassis assembly; and a cross brace, said cross brace being formed by two interlocking cross members, each of said cross members having a plurality of spring tabs to interlock with selected slots in said front member and said rear wall.

2. The printer chassis of claim 1 further comprising at least one inner wall, said inner wall being between said side walls and having a plurality of spring tabs to interlock with selected slots in each of said front member and said rear wall, said inner wall having a first notch to interlock with a corresponding second notch of said cross member.

3. The printer chassis of claim 2 further comprising at least one full length cross strut, positioned above said side walls, said cross strut having selected slots to interlock with spring tabs on each of said side walls and said inner wall.

4. The printer chassis of claim 2 further comprising at least one short strut positioned above said side wall and said inner wall, said short strut having selected slots to interlock with spring tabs on each of said side wall and said inner wall.

5. The printer chassis of claim 1 further comprising a base positioned below said side walls, said base having a plurality of slots to mate with spring tabs on either of said side walls.

6. The printer chassis of claim 1 constructed from sheet metal.

7. The printer chassis of claim 1 constructed from 0.090 inch thick steel sheet metal.

8. The printer chassis of claim 1 further comprising an imaging drum attached to said printer chassis.

* * * * *